US006118229A

United States Patent [19]

Lee

[11] Patent Number: 6,118,229

[45] Date of Patent: Sep. 12, 2000

[54] PLASMA DISPLAY

[76] Inventor: Jung Dong Lee, 39 Pointe Ter., Atlanta, Ga. 30339

[21] Appl. No.: 09/324,701

[22] Filed: Jun. 2, 1999

Related U.S. Application Data

[60] Provisional application No. 60/088,005, Jun. 4, 1998.

[51] Int. Cl.[7] ..... G05F 1/00

[52] U.S. Cl. ..... 315/307; 315/169.4; 315/282; 315/224; 315/291; 315/289

[58] Field of Search ..... 315/307, 58, 85, 315/289, 326, 224, 291, 149, 169.4

[56] References Cited

U.S. PATENT DOCUMENTS

| | | | |
|---|---|---|---|
| D. 326,574 | 6/1992 | Albright et al. | D6/472 |
| 4,379,253 | 4/1983 | Myer | 315/289 |
| 4,754,199 | 6/1988 | Parker | 315/85 |
| 4,956,579 | 9/1990 | Albright | 315/58 |
| 5,281,898 | 1/1994 | Albright | 315/326 |
| 5,747,942 | 5/1998 | Ranganath | 315/224 |
| 5,912,536 | 6/1999 | Michiels et al. | 315/248 |

*Primary Examiner*—Don Wong
*Assistant Examiner*—Trinh Vo Dinh
*Attorney, Agent, or Firm*—Needle & Rosenberg, P.C.

[57] ABSTRACT

A plasma display including a bulb having an outer and an inner bulb portion hermetically connected with the outer bulb portion to thereby create a hermetically sealed chamber and an inventive circuit to provide electricity to create illuminating arcs of plasma in an inert atmosphere in the sealed chamber. The inner bulb portion has an inner surface and an outer surface facing the sealed chamber, and there is a conductive coating on the inner surface. An inventive discharging gas is infused into the sealed chamber and electricity of varying voltage is supplied through the circuit to the conductive coating to cause visible plasma arcs of electricity between the inner and outer bulb portion. In a first embodiment, the outer bulb portion is preferably spherical, and the inner bulb portion is preferably tubular and contained within the outer bulb portion with the conductive coating being located substantially in the center of the spherical outer bulb portion. In a second embodiment, the outer bulb portion is U-shaped and the inner bulb portion is on the inner curve of the U-shape such that the conductive coating is at substantially the apex of the inner curve of the inner bulb portion of the U-shape.

18 Claims, 6 Drawing Sheets

PLASMA DISPLAY

CROSS-REFERENCE TO RELATED APPLICATION

This application claims the benefit of U.S. Provisional Application No. 60/088,005, filed Jun. 4, 1998.

BACKGROUND OF THE INVENTION

1. Field of the Invention

The present invention generally relates to lighting devices. More particularly, the present invention relates to ornamental lighting devices which display illuminating arcs of plasma.

2. Description of the Related Art

Several display lamps are known in the art which display arcs of plasma from an electrical discharge, sometimes imitating lightning. These display lamps typically have a nonconductive shell containing specific ionizable gases, such as neon (Ne), argon (Ar), krypton (Kr), helium (He), and xenon (Xe), and one or more electrodes disposed in the inert atmosphere. High voltage electricity is the directed to the electrodes to specifically cause arcs of plasma in the inert atmosphere. Several designs utilize either spherically shaped sealed envelopes or cylindrical sealed envelopes to hold the inert gases captive. In some instances, the intensity and location of a specific plasma arc discharge in the plasma display lamp can be altered with the proximity of a conductive body such as a person's hand.

U.S. Pat. No. 4,956,579 and U.S. Pat. No. Des. 326,574 disclose a plasma display having a double-walled disclosure. The plasma display includes a gas-containing envelope that forms a cylinder and an electrode is disposed on the sealed envelope to cause plasma arcs therein upon the supply of a constant alternating current (AC) signal from an AC adapter to the electrode. The '579 patent does not disclose a specific composition of ionizable gas for use in the envelope or the use of voltage and frequency manipulation to cause changes in the plasma arcs, and their interrelation.

U.S. Pat. No. 4,754,199 discloses a self-contained gas discharge display device that includes a single electrode in a discharge chamber comprised of the upper portion of a dome. The device of this patent particularly includes a shield means to establish discharge-supporting electric fields in the discharge chamber, the shield being located between the base and the discharge chamber.

U.S. Pat. No. 4,379,253 discloses an ornamental discharge lamp and is particularly directed towards the power supply of the lamp. The lamp includes one or more electrodes in a light-transmitting envelope containing an ionizable fluid. The ornamental lamp uses an oscillator and by modifying the oscillator voltage to the electrode(s) in the lamp, changing the position of the electrodes, and changing the discharging gas, effects changes in the discharge designs and colors. The voltage disclosed for transmission to the electrode(s) is 10,000 volts or higher.

U.S. Pat. No. 5,281,898 discloses a display device which has a double-walled envelope with a plurality of electrodes therein. The plurality of electrodes receive an AC high voltage current (up to 15,000 volts) to cause a discharge between the electrodes in the envelope. The cycling of the alternating current (120 hz) causes re-ionization of the discharging gas and establishes a new plasma arc from one electrode to the other to cause a "flickering display."

SUMMARY OF THE INVENTION

Briefly described, in a preferred embodiment thereof, the present invention is a plasma display which comprises a bulb having an outer bulb portion and an inner bulb portion hermetically connected with said outer bulb portion, thereby creating a hermetically sealed chamber. The inner bulb portion has an inner surface and an outer surface facing the chamber, and a conductive coating is on the inner surface of said inner portion. The sealed chamber has an access port that allows selectively creating a vacuum and infusing a discharging gas into the chamber for selectively providing electricity of varying voltage and frequency to the conductive coating of the inner bulb portion, wherein supplying voltage to the conductive coating causes visible arcs of plasma between the inner bulb portion and outer bulb portion and varying the voltage of the electricity changes the visual appearance of the plasma arcs.

In a first embodiment, the plasma display has the outer bulb portion as spherical and the inner bulb is tubular and contained within said outer portion, said conductive coating being located substantially in the center of said spherical outer bulb portion. The first embodiment of the plasma display preferably has an infused discharging gas comprised of 93%–96% Kr; 2%–5% Xe; 1%–3% He; 1%–3% N; and 50–500 ppm O. In such embodiment, the discharging gas provides particularly colorful arcs of plasma between the outer and inner bulb portions which can vary in color and intensity with variances in frequency and voltage. Accordingly, to achieve the best visual effects, electricity is optimally provided to the conductive coating of the first embodiment at a constant voltage in a range of 75 Khz to 85 Khz and about 6,000–7,000 volts.

In a second embodiment, the plasma display has the outer bulb portion as U-shaped and the inner bulb portion on the inner curve of the U-shape, and the conductive coating is at substantially the apex on the inner face of the inner curve of the inner bulb portion. The second embodiment of the plasma display preferably has an infused discharging gas comprised of 93%–96% Ne; 2%–5% Xe; 1%–3% He; 1%–3% N; and 50–500 ppm O. To achieve the best visual effects with the plasma arcs, electricity is optimally provided to the conductive coating of the second at a constant voltage in a range of 90 Khz to 100 Khz and at about 6,000–7,000 volts.

The second embodiment has several display capabilities wherein either simple flickering plasmas arcs are displayed, the flickering plasma arcs can be affected by the input of a sensor, or a "shower-type" effect of plasma is effected through lowering the frequency of the voltage. These modes can be selected independently or together with the appropriate circuit for the second embodiment.

The preferred circuit for providing high frequency-high voltage to the plasma display comprises a line filter that eliminates noise in the circuit, a rectifier that rectifies voltage input to the circuit, a sensor that selectively variegates the output of the circuit, a reset switch that automatically resets the circuit, a switching driver that converts voltage supplied to the plasma display to high frequency voltage, and an output driver that converts the high frequency voltage into high frequency-high voltage. Importantly, the preferred circuit does not require an AC adapter for usage of household AC.

The preferred sensor is a sound sensor. And the switching driver is preferably comprised of a current coil, at least one Zener diode, and a condenser, which converts the voltage to voltage having a frequency in a range of 75 Khz to 85 Khz for the first embodiment of the plasma display, and converts the voltage to voltage having a frequency in a range of 90 Khz to 100 Khz for the second embodiment of the plasma display. There is further included a flyback transformer that converts the voltage in the first embodiment having a frequency in a range of 75 Khz to 85 Khz to further have a voltage of about 6,000–7,000 volts, and converts the voltage of the second embodiment having a frequency in a range of 90 Khz to 100 Khz to further have a voltage of about 6,000–7,000 volts.

Other objects, advantages and features of the present invention will become apparent after review of the hereinafter set forth Brief Description of the Drawings, Detailed Description of the Invention, and Claims appended herewith.

DETAILED DESCRIPTION OF THE INVENTION

Figure 1:
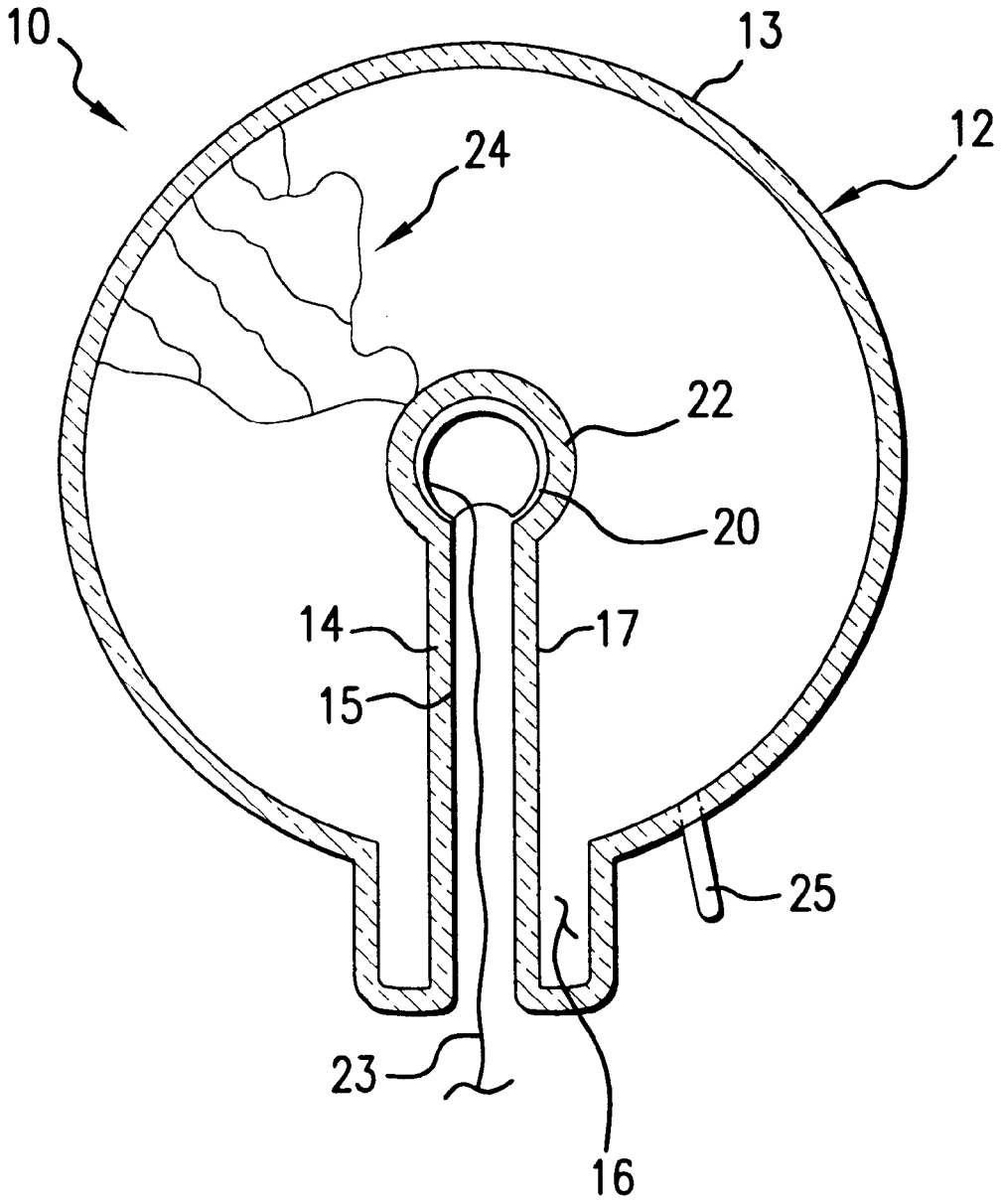
FIG. 1 is a cross section of the first embodiment of the plasma display in which the outer bulb portion is spherical and in the inner bulb portion is cylindrical with the electrode substantially in the center of the spherical outer bulb.

Referring now to the drawings in which like numerals represent like elements throughout the several views, FIG. 1 illustrates a first embodiment of a plasma display 10 comprised of a bulb 12 having an outer bulb portion 13, and an inner bulb portion 14 hermetically connected with said outer bulb portion 13, thereby creating a hermetically sealed chamber 16. The inner bulb portion 14 has an inner surface 15 and an outer surface 17 facing the chamber 16. A conductive coating 20 is on the inner surface 15 of the inner bulb portion 14 and an electrical supply wire 23 is conductively connected thereto to selectively provide an electrical current to the conductive coating 20 to form an electrode 22 which is located substantially in the center of the outer bulb portion 13. The conductive coating 20 is preferably graphite, although other conductive materials are alternately used, such as known metallic, carbon, and/or ceramic conductors. Moreover, the supply wire 23 is only one device for providing current to the conductive coating 20, other methods and devices as known in the art are alternately used, such as providing a continuous conductive coating forming a wire adhered to the inner surface 15 of the inner bulb portion 14.

A tube 25 is connected to the sealed chamber 16 such that a vacuum is selectively created in the chamber 16 and a discharging gas is filled into the chamber 16. Thus, supplying voltage to the conductive coating 20 causes visible arcs of plasma 24 within the discharging gas between the outer bulb portion 13 and inner bulb portion 14. Selectively varying voltage and frequency of the electricity provided to the conductive coating 20 through the wire 23, or other conductive connection, to the conductive coating 20 causes changes in the locations, shape and color of the discharge. Accordingly, when a sensor or other device is connected to the electrical supply, as further discussed below, the frequency and voltage are selectively variegated in accord with sensor-positive input, such as sound, light, heat, infrared, and other sensed characteristics as are known in the art, and the plasma arcs 24 are selectively altered in accord therewith.

The preferred discharging gas for the first embodiment of the plasma display is preferably comprised of 93%–96% Kr; 2%–5% Xe; 1%–4% He; 1%–4% N; and 50–500 ppm O. Such gas will effect red-blue arcs of plasma between the outer bulb portion 13 and inner bulb portion 14 and the discharges are optimized when the preferred ranges of frequency and voltage provided to the plasma display, as further discussed herein, are used.

Figure 2:
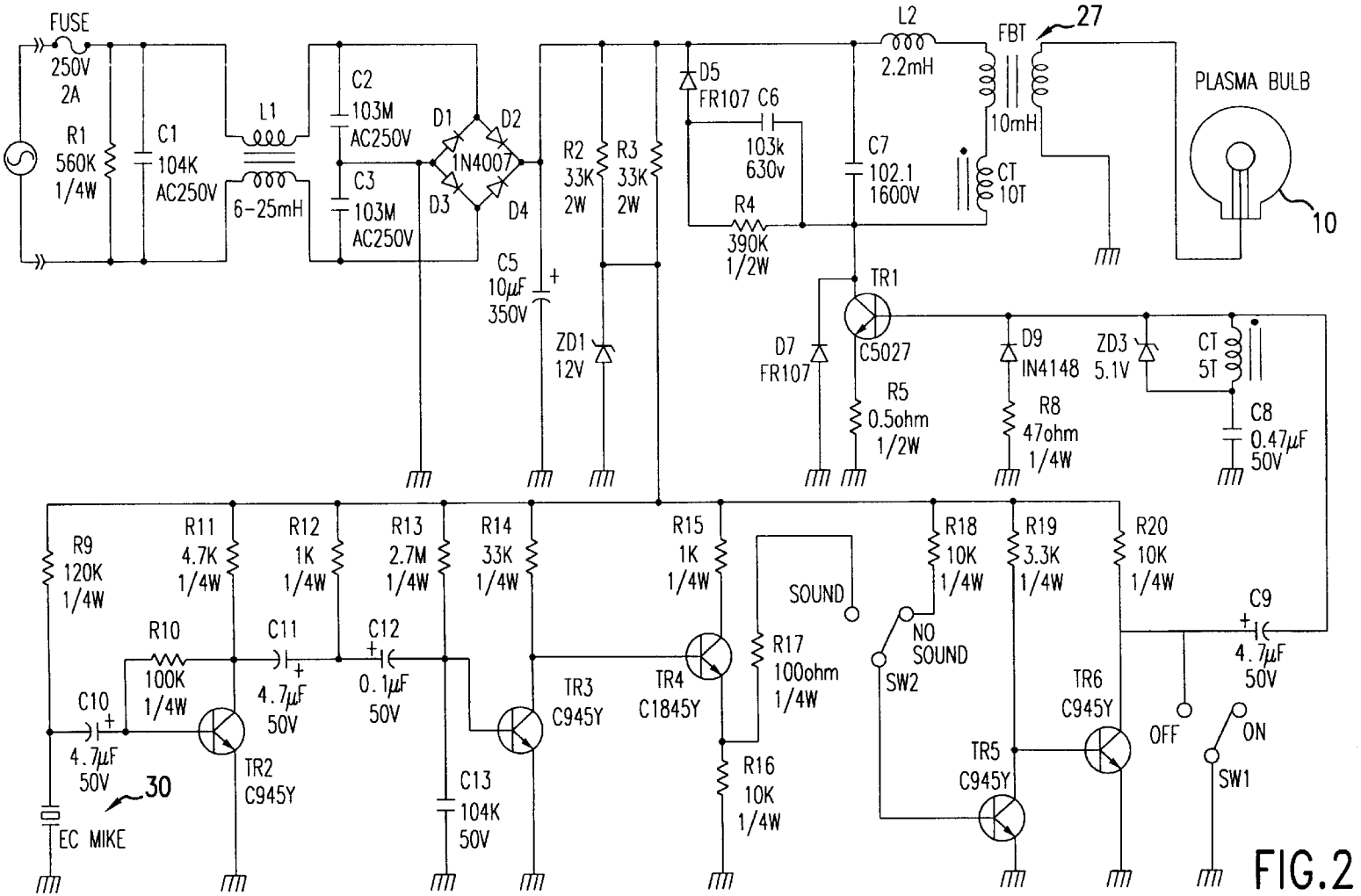
FIG. 2 is a schematic diagram of the preferred circuit for the first embodiment of the plasma display.

FIG. 2 is a schematic diagram for the preferred circuit for the first embodiment of the plasma display, the functioning of which is more thoroughly discussed below. In regard to the first embodiment, electricity is provided a constant voltage in a range of 75 Khz to 85 Khz. The flyback transformer 27 converts the voltage having a frequency in a range of 75 Khz to 85 Khz to further have a high voltage of about 6,000–7,000 volts. Sensor 30 is shown as a microphone in the schematic of FIG. 2.

Figure 3:
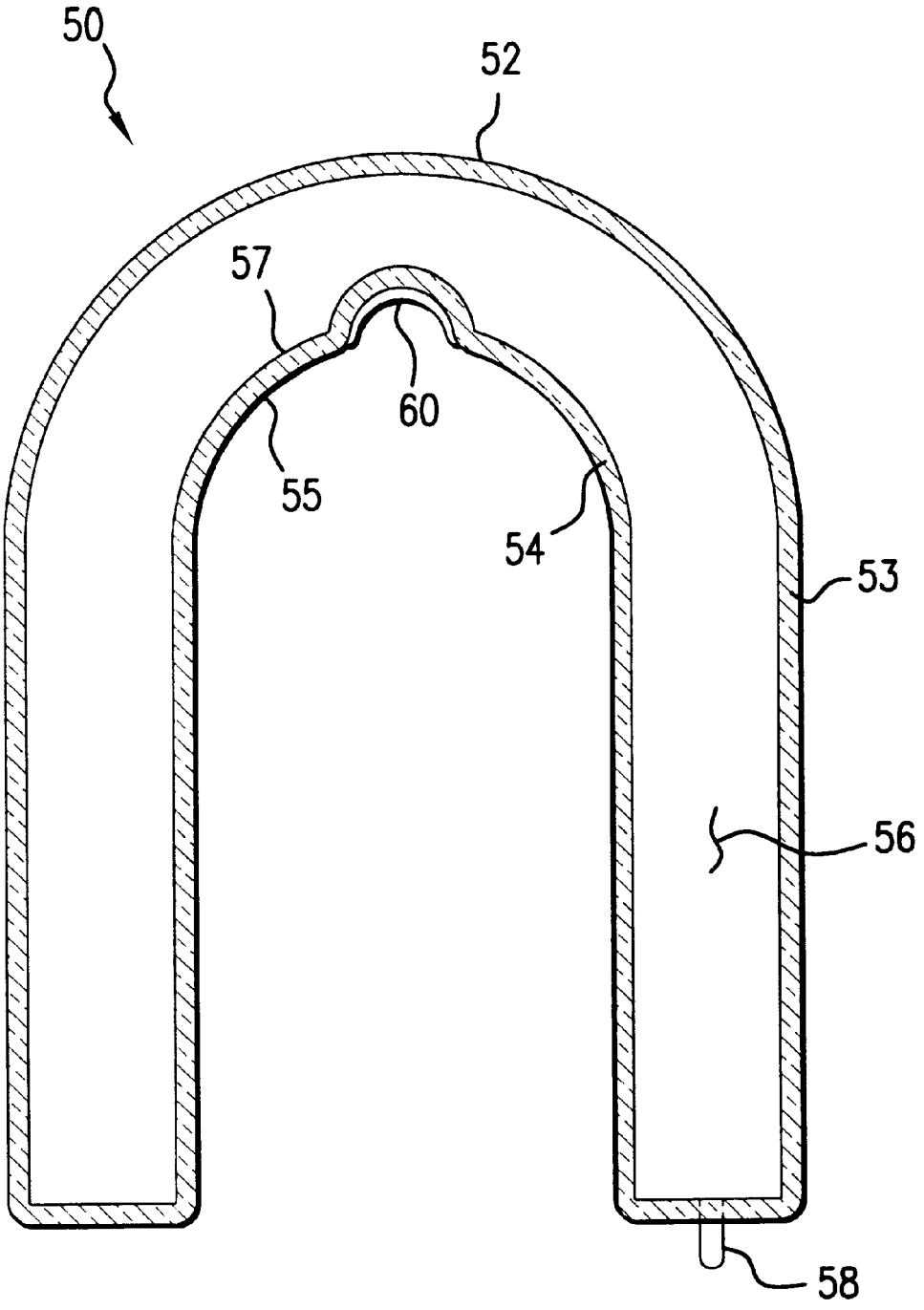
FIG. 3 is a cross section of the second embodiment of the plasma display in which the outer bulb portion is U-shaped and the inner bulb portion is on the inner curve of the U-shape with the conductive coating at substantially the apex of the inner curve of the inner bulb portion.

FIG. 3 illustrates a second embodiment of the plasma display 50 wherein the bulb 52 is U-shaped and the inner bulb portion 54 is on the inner curve 57 of the U-shape, and the conductive coating 60 is on the outer surface 55 of the inner bulb portion 54 at substantially the apex of the inner curve of the inner bulb portion 54 of the U-shape. A hermetically sealed chamber 56 is formed between the outer bulb portion 53 and inner bulb portion 54, with access tube 58 providing access to the sealed chamber 56 to infuse a discharging gas in an inert atmosphere.

The preferred discharging gas for the sealed chamber 56 of the second embodiment of the plasma display 50 is comprised of: 93%–96% Ne; 2%–5% Xe; 1%–4% He; 1%–3% N; and 50–500 ppm O. Such discharging gas provides mostly white plasma arcs with slight shades of green when an electric current is applied.

Figure 4:
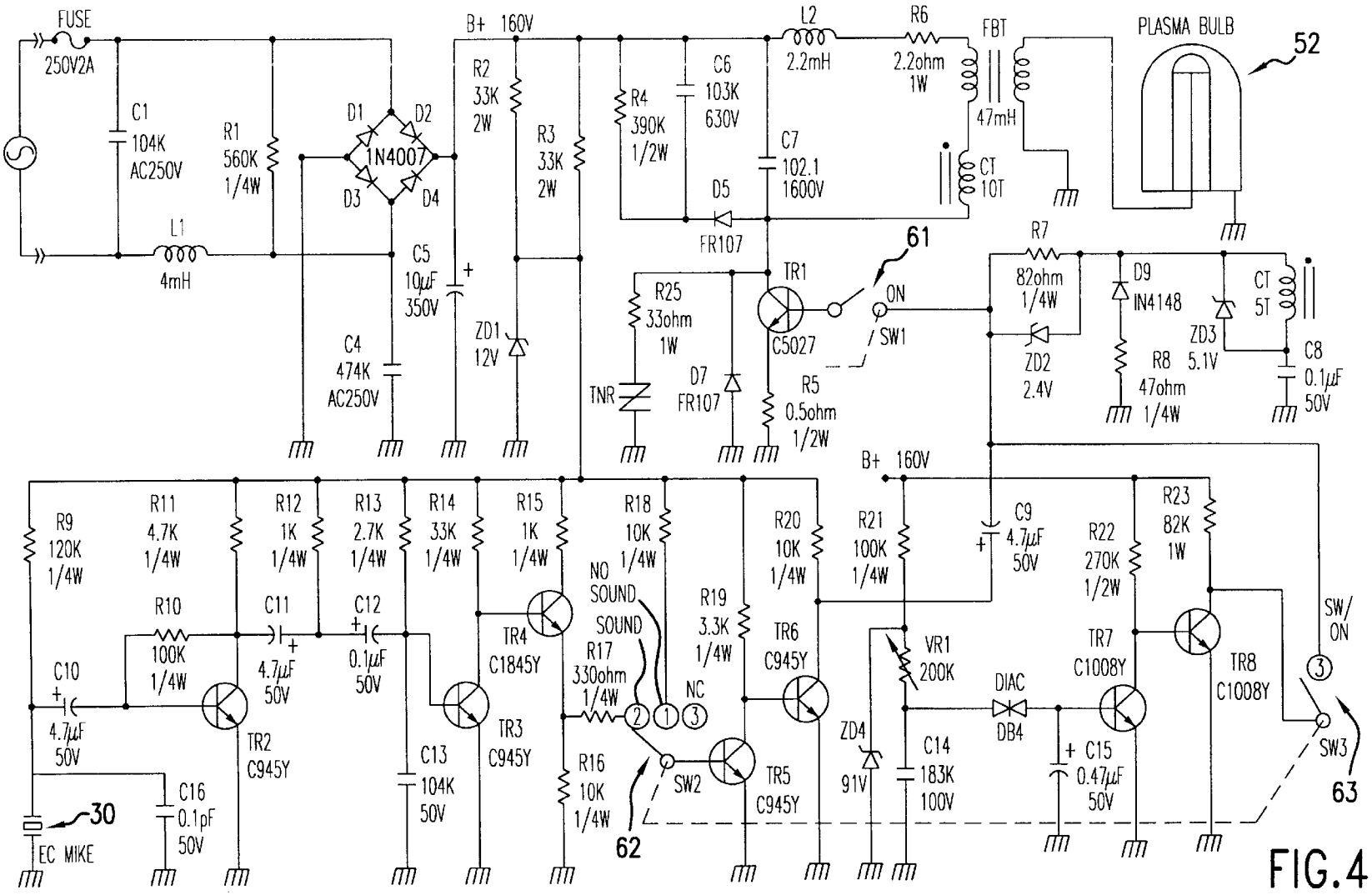
FIG. 4 is a schematic diagram of the preferred circuit for the second embodiment of the plasma display.

The second embodiment also has the capability to create a "shower-type" display by reducing the frequency to the electrode to about 2–3 Khz to the fly-back transformer, shown as fly back transformer 61 in FIG. 4. The shower-type display mode can be the primary function of the plasma display 50 when turned on or can be a selected function among activating the plasma display to: (1) discharge at a 120 Hz or less flicker, (2) discharge selectively due to sensor input; or (3) form a shower-type display.

FIG. 4 is a schematic diagram for the preferred circuit to provide electricity to the second embodiment of the plasma display. In such embodiment it is preferred that electricity is provided to the plasma display at a constant voltage in a frequency range of 90 Khz to 100 Khz to produce a voltage of about 6,000–7,000 volts. FIG. 4 illustrates the preferred circuit with three gates: Gate G1 for closing the circuit and turning the plasma on; Gate G2 for turning the sound sensor on; and Gate 3 for turning on a shower-type display. The gates are shown as switches 5, 6, 7 in FIG. 6. The sensor and shower-type display can be used together or independently when the plasma display 52 is displaying illuminating arcs of plasma.

Figure 5:
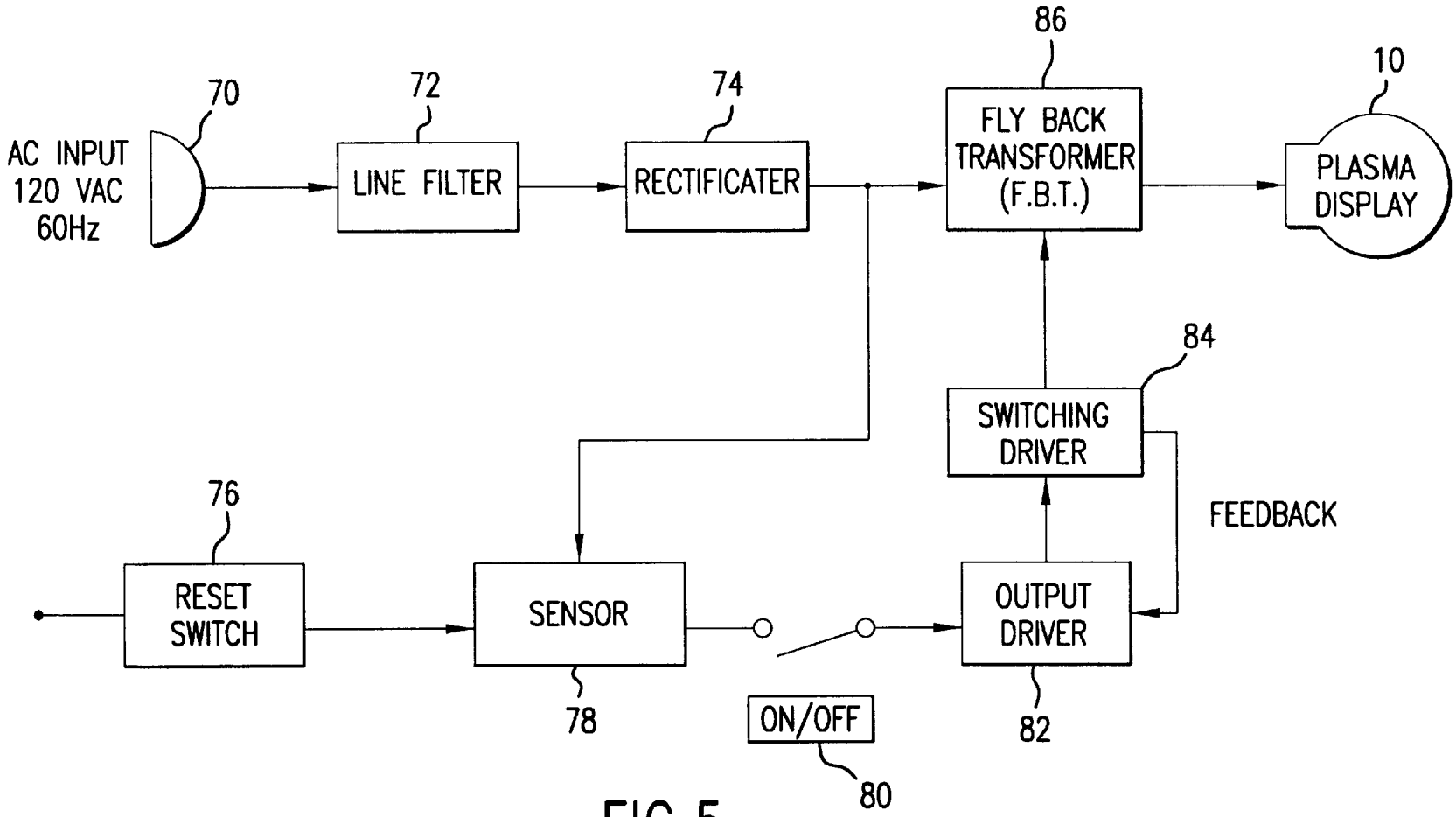
FIG. 5 is a block diagram of the preferred circuit for the first embodiment of the plasma display.

FIG. 5 is a block diagram for the preferred circuit providing high frequency high voltage to the plasma display 10 which is connected to an AC power source 70. The inventive circuit does not require an AC adapter to step down the AC voltage for conversion in the circuit, as is common in the prior art. The inventive circuit particularly includes a line filter 72 that eliminates noise in the circuit, and a rectifier 74 that rectifies the AC voltage input into to circuit from the AC source 70. A sensor 78 selectively variegates the output of the circuit and, as discussed above, one preferred sensor is a sound sensor that variegates the output in accordance with outside sounds, i.e. claps, music, voices, and the like.

The preferred circuit further includes: a reset switch 76 that automatically resets the circuit upon failure of the circuit to load; an output driver 82 that switches the feed back when the circuit is closed from the sensor 78 into high frequency voltage; and a switching driver 84 that converts voltage supplied to the plasma display from the output driver 82 to high frequency voltage. The switching driver 84 is preferably comprised of a current coil, at least one Zener diode, and a condenser. A flyback transformer 86 converts the high frequency voltage from the switching driver 84 into high frequency-high voltage which is then input into the plasma display 10. An on/off switch 80 is shown as selectively closing the circuit to activate the sensor 78 variegation of the plasma display 10. There can be one or more on/off switches that alternately provide a constant voltage to the plasma lamp 10, provide variegated voltage from a sensor 78, or provide low frequency voltage to cause a "shower-type" plasma arcing effect, as is illustrated in the schematic diagram of FIG. 4.

In operation, 120 VAC input voltage (a common household voltage) is input into the circuit from AC source 70. Line Filter 72 eliminates the noise signal generated from the circuit. Rectificater 74 converts 120 VAC input voltage to 160 DC voltage through a rectification circuit preferably comprised of a diode and a condenser. Switching driver 84 then supplies a constant voltage of 75–85 Khz in the first embodiment, or 90–100 kHz in the second embodiment, that is switched through the coil and condenser from the already rectified 160 DC voltage to output driver 82. Output driver 82 is preferably a switching transistor that supplies as input (first coil) to the flyback transformer 86. Flyback transformer 86, upon receiving the converted high frequency voltage of 75–85 kHz through the first coil, creates high voltage of approximately 6,000–7,000 volts in the second coil by electromagnetic induction.

Figure 6:
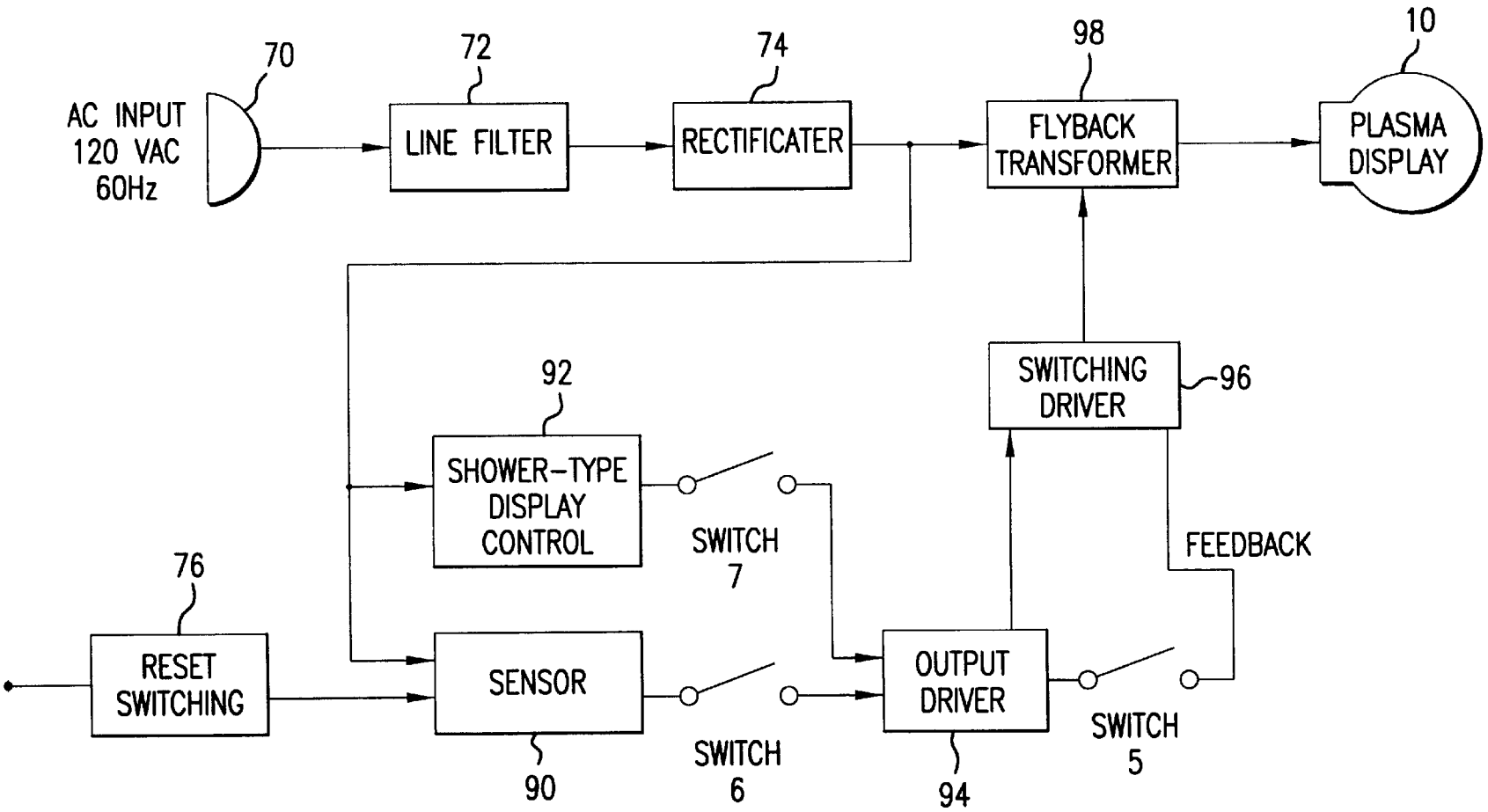
FIG. 6 is a block diagram of the preferred circuit for the second embodiment of the plasma display.

FIG. 6 is a block diagram for the circuit for the second embodiment of the plasma display, and reflects the schematic diagram of FIG. 4. The operation of this embodiment of the circuit is similar to the first embodiment, except that two alternate controls can be employed, specifically sensor 90, and shower-type control 92. Switch 5 serves to close the circuit such that the plasma display 10 is activated and plasma arcs form therein. In addition, switch 6 can be closed to have sensor 90 activate frequency and/or voltage modulation to selectively affect the plasma display 10, and shower-type display control 92 can be activated through closing switch 7 such that the frequency is lowered to cause a shower-type effect in the plasma display 10. Both sensor 90 and shower-type display control 92, when the circuit is closed, go to output driver 94, and high frequency voltage is then routed to switching driver 96, with feedback returning to output driver 94. The flyback transformer 98 then transmits the high frequency voltage to high frequency-high voltage prior to such input into the plasma display 10.

While there has been shown a preferred and alternate embodiments of the present invention, it is to be understood that certain changes may be made in the forms and arrangement of the elements without departing from the underlying spirit and scope of the present invention as set forth in the claims appended herewith. Further, all means or step-plus-function language appearing in the claims is intended to cover not only the structures disclosed above but to encompass all equivalent structures, materials, acts, and methods known to those of skill in the art in implementing the present invention.

What is claimed is:

1. A plasma display, comprising:

a bulb having an outer bulb portion and an inner bulb portion hermetically connected with said outer bulb portion thereby creating a hermetically sealed chamber, said inner bulb portion having an inner surface and an outer surface facing said chamber, said bulb further having a conductive coating on said inner surface of said inner portion;

air control means for selectively creating a vacuum and infusing a discharging gas into said chamber, said discharging gas selected from the group comprised of: the combination of: 93–96% Kr, 2%–5% Xe, 1%–4% He, 1%–3% N, and 50–500 ppm O; and the combination of: 93%–96% Ne, 2%–5% Xe, 1%–4% He, 1%–3% N, and 50–500 ppm O; and means for selectively providing electricity of varying voltage and frequency to said conductive coating of said inner surface of said inner bulb portion, wherein supplying voltage to said conductive coating causes visible arcs of plasma between said inner bulb portion to said outer bulb portion and varying the voltage of the electricity changes the visual appearance of said plasma arcs.

2. The plasma display of claim 1, wherein said outer bulb portion is spherical, and said inner bulb is tubular and contained within said outer portion, said conductive coating being located substantially in the center of said spherical outer bulb portion.

3. The plasma display of claim 1, wherein said bulb is U-shaped and said inner bulb portion is on the inner curve of the U-shape, and said conductive coating is at substantially an apex of the inner curve of the inner bulb portion of the U-shape.

4. The plasma display of claim 1, wherein said means for selectively providing electricity provides a constant voltage in a range of 75 Khz to 85 Khz when said discharging gas is comprised of 93–96% Kr, 2%–5% Xe, 1%–4% He, 1%–3% N, and 50–500 ppm O.

5. The plasma display of claim 1, wherein said means for selectively providing electricity provides a constant voltage in a range of 90 Khz to 85 Khz when said discharging gas is comprised of 93%–96% Ne, 2%–5% Xe, 1%–4% He, 1%–3% N, and 50–500 ppm O.

6. A plasma display, comprising:

a bulb having an inner and outer bulb portion, said inner bulb portion including a conductive coating, and a discharging gas hermetically contained between said inner and outer portions;

electrical supply means for supplying an electrical current to said conductive coating thereby creating a circuit between said inner and outer bulb portions wherein supplying the electrical current to said conductive coating causes illuminating arcs of plasma between said inner and outer bulb portions;

a line filter for eliminating noise generated by said circuit;

a sound sensor for changing characteristics of the electrical current in response to audible events; and reset switching means to automatically reset the circuit.

7. The plasma display of claim 6, wherein said discharging gas is comprised of 93%–96% Kr; 2%–5% Xe; 1%–4% He; 1%–3% N; and 50–500 ppm O.

8. The plasma display of claim 7, wherein said electrical supply means supplies the electrical current at 75–85 Khz.

9. The plasma display of claim 8, wherein said discharging gas is comprised of 93%–96% Ne; 2%–5% Xe; 1%–4% He; 1%–3% N; and 50–500 ppm O.

10. The plasma display of claim 9, wherein said electrical supply means supplies the electrical current at 90 Khz to 100 Khz.

11. A discharging gas for promoting illuminating arcs of plasma in an inert atmosphere when subjected to an electrical voltage differential; said gas comprised of: 93%–96% Kr; 2%–5% Xe; 1%–4% He; 1%–3% N; and 50–500 ppm O.

12. A discharging gas for promoting illuminating arcs of plasma in an inert atmosphere when subjected to an electrical voltage differential, said gas comprised of: 93%–96% Ne; 2%–5% Xe; 1%–4% He; 1%–3% N; and 50–500 ppm O.

13. A circuit for providing high frequency high voltage to a plasma display, comprising:

a line filter that eliminates noise in said circuit;

a rectifier that rectifies voltage input to said circuit;

a sound sensor that selectively variegates the output of said circuit;

a reset switch that automatically resets the circuit;

a switching driver that converts voltage supplied to the plasma display to high frequency voltage;

an output driver that switches feed back from said sensor into high frequency voltage; and a flyback transformer that converts the high frequency voltage into high frequency high voltage.

14. The circuit of claim 13, wherein said switching driver is comprised of a current coil, at least one Zener diode, and a condenser.

15. The circuit of claim 13, wherein said switching driver converts the voltage to voltage having a frequency in a range of 75 Khz to 85 Khz.

16. The circuit of claim 13, wherein said switching driver converts the voltage to voltage having a frequency in a range of 90 Khz to 100 Khz.

17. The circuit of claim 15, wherein said flyback transformer converts the voltage having a frequency in a range of 75 Khz to 85 Khz to further have a voltage of about 6,000–7,000 volts.

18. The circuit of claim 16, wherein said flyback transformer converts the voltage having a frequency in a range of 90 Khz to 100 Khz to further have a voltage of about 6,000–7,000 volts.

* * * * *